US005146768A

United States Patent [19]

Dichtel

[11] Patent Number: 5,146,768

[45] Date of Patent: Sep. 15, 1992

[54] BENDABLE EARRING AND METHOD OF MAKING SAME

[76] Inventor: Connie Dichtel, 22316 Strathern St., Canoga Park, Calif. 91304

[21] Appl. No.: 796,560

[22] Filed: Nov. 22, 1991

[51] Int. Cl.[5] ..... A44C 7/00

[52] U.S. Cl. ..... 63/14.8; 63/14.2

[58] Field of Search ..... 63/14.1, 12, 13, 14.8

[56] References Cited

U.S. PATENT DOCUMENTS

| | | | |
|---|---|---|---|
| D.155,511 | 10/1949 | Janousek . | |
| 276,993 | 5/1883 | Arnold | 63/12 |
| D. 295,267 | 4/1988 | Saraga . | |
| 869,965 | 11/1907 | Farnham . | |
| 1,743,006 | 1/1930 | Prescott-Richardson | 63/12 |
| 1,791,567 | 2/1931 | Meyer . | |
| 2,383,448 | 8/1945 | Christy . | |
| 2,510,511 | 6/1950 | Mittendorf . | |
| 2,611,251 | 9/1952 | Guth . | |
| 2,669,102 | 2/1954 | Ronstadt . | |
| 2,704,872 | 3/1955 | Waggoner . | |
| 2,739,596 | 3/1956 | Roberts | 63/12 |
| 2,803,953 | 8/1957 | Zubalik . | |
| 3,071,938 | 1/1963 | Davidson | 63/13 |
| 3,345,830 | 10/1967 | Fontaine | 63/13 |
| 3,400,556 | 9/1968 | Walsh et al. . | |
| 3,504,507 | 4/1970 | Ferro | 63/12 |
| 3,739,599 | 6/1973 | Melone . | |
| 3,898,868 | 8/1975 | Tomlinson | 63/14.1 |
| 4,259,850 | 4/1981 | Lalieu | 63/13 |
| 4,282,721 | 8/1981 | Roach | 63/14.1 |
| 4,704,878 | 11/1987 | Saraga . | |
| 4,827,738 | 5/1989 | Rothal | 63/14.1 |

FOREIGN PATENT DOCUMENTS

| | | | |
|---|---|---|---|
| 2570582 | 3/1986 | France | 63/12 |

*Primary Examiner*—Renee S. Luebke
*Assistant Examiner*—Michael Milano

[57] ABSTRACT

The bendable loop earring includes a generally U-shaped, preferably cylindrical bendable pin having a central shaft and two opposite integral opposite ends with a pair of curved beads connected thereto, one per pin end at the pin ends. The beads can be releasably connected to the shaft, or one or both can be permanently secured thereto. The curved surfaces of the beads closely face each other for releasably point-gripping an earlobe. An ornament can be slidably received on the shaft and free to move thereon, but prevented by the beads from the separating from the earring. In one embodiment the pin has an expanded head against which a first bead abuts and is sealed in place by epoxy or other bonding material. The opposite end of the pin is threaded and the second bead is releasably threaded thereto. The method of the present invention effects the formation of that earring. In that regard, the beaded pin is initially straight with its threaded end held vertically down and up over which is slipped the first bead. The pin shaft adjacent the head is coated with liquid bonding agent, after which the pin is driven vertically down through a horizontal pad of styrofoam or the like until the first bead is seated over the bonding material against the head until the bonding material sets to permanently hold that bead in place.

2 Claims, 2 Drawing Sheets

BENDABLE EARRING AND METHOD OF MAKING SAME

BACKGROUND OF THE INVENTION

1. Field of the Invention

The present invention generally relates to decorative items and more particularly to improved earrings and to a method of making the same.

2. Prior Art

Two general types of earrings are currently being used. One type has a pivotable cross pin and is for pierced ears. It is very popular because the earring can be made inexpensively. However, some children, adolescents and women cannot have their ears pierced successfully, due either to their tender age and/or to the danger of ear lobe infections, etc.

The other type of earring is the clamp or clip type. However, these earrings are expensive, usually not made in precious metal and are necessarily heavy because of the clamp or clip. They are generally uncomfortable because of their heavy weight and sometimes produce skin irritations because of the usual large clamping area of surface contact with the skin of the earlobe.

Accordingly, there is a need for an improved type of earring which will avoid having to pierce the ears, yet will be inexpensive to make and light in weight and will hold tightly against the earlobes without slipping and without skin irritation. Such earring should preferably have improved ornamentation means, such as a sliding ornament or the like which can be replaced at will to suit various occasions.

SUMMARY OF THE INVENTION

The improved earring of the present invention and the improved present method of making the same satisfy all the foregoing needs. The earring and method are substantially as set forth in the Abstract of the Disclosure.

Thus, the earring comprises an elongated, preferably cylindrical straight pin of readily bendable metal, which has been bent into an open loop or generally U-shape. The pin has a pair of opposed opposite ends and a shaft therebetween. Each pin end bears a curved bead, with the curved surfaces of the beads closely spaced apart and opposite each other. The beads can be fixedly mounted to the pin, or, alternatively, one or both of the beads can be removable from the pin so that an ornament slideably mounted on the shaft and trapped from removal by the beads, can easily be removed and replaced when that bead is removed from the pin. Preferably, one or both beads are threaded on the ends of the pin.

In one embodiment, the pin, before it is formed into the earring, is a straight pin with an expanded head at its top end and a threaded opposite lower end. In accordance with the present method, that pin is formed into the earring by:

a) first slipping a holed bead onto the shaft from the lower end thereof;
b) coating the upper end of the shaft adjacent the head with a settable liquid bonding agent such as epoxy resin;
c) forcing the lower end of the pin down through a horizontal pad of, for example, styrofoam, until the bead on the shaft is forced up against the head, and then holding it therebetween the pad and head until the bonding agent sets and anchors it in place;
d) removing the pin from the pad and slipping on the shaft from the free lower end thereof a slideable dangle ornament or the like, as by a slip ring having a diameter less than that of the anchored bead;
e) threading on a second bead at the lower end of the pin, the diameter of which bead is greater than the diameter of the slip ring, thus trapping the ornament on the shaft between the beads, but allowing it to slide freely on the shaft; and,
f) bending the shaft into an open loop or general U-shape with the two beads closely spaced apart.

In a second embodiment wherein the earring has beads fixedly secured to the pin, the following method of construction is used:

a) slipping a holed bead onto a pin having a shaft with an expanded head on the upper end thereof,
b) coating the upper end of the shaft adjacent the expanded head with a settable liquid bonding agent,
c) forcing the pin down through a porous pad of styrofoam until the bead is forced up to the expanded head and holding it there until the bonding agent sets and anchors the bead to the shaft,
d) removing the pin from the pad and coating the lower end of the shaft with a bonding agent,
e) placing a holed bead over the lower end of the shaft and holding it there until the bonding agent sets; and,
f) bending the shaft into an open loop or general U-shape with the beads closely spaced apart.

Alternatively, step (d) can be dispensed with so that no ornament is slipped over the shaft. In this case, the second bead can be fixedly secured to the lower end of the shaft.

When the earring is to be put on an earlobe, the beads are positioned adjacent the outer and inner surfaces of the earlobe and then pinched together. The point contact of the beads with the earlobe assures no discomfort, an adequate hold and freedom of danger of skin irritation from the beads.

Various other features of the invention are set forth in the following detailed description and accompanying drawings.

DRAWINGS

DETAILED DESCRIPTION

FIG. 1

Figure 1:
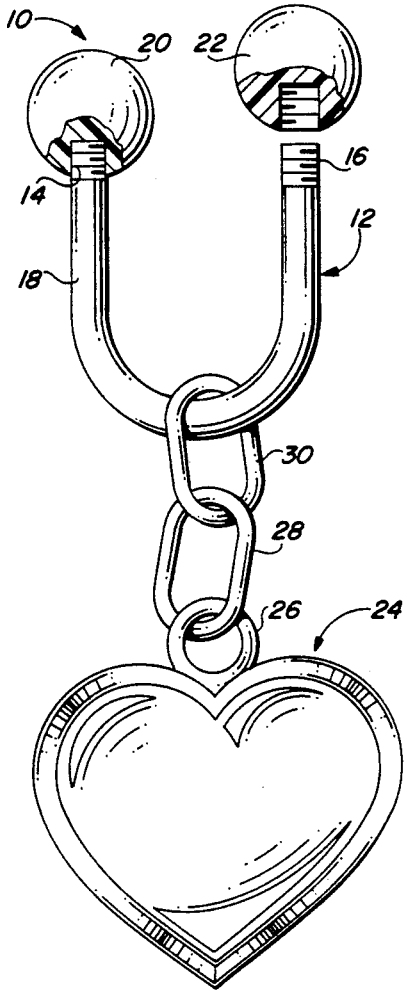
FIG. 1 is a schematic front elevation, partly broken away, of a first preferred embodiment of the improved earring of the present invention.

Now referring more particularly to FIG. 1 of the drawings, a first preferred embodiment of the improved earring of the present invention is schematically depicted therein. Thus, earring 10 is shown, which comprises an elongated cylindrical pin 12, generally circular in cross-section, and of readily bendable metal, such as copper, aluminum, soft iron , etc., with or without an external bendable plating. Pin 12 has two opposite ends 14 and 16 and an elongated shaft 18 therebetween and integral therewith. Ends 14 and 16 are threaded. Shaft 18 is U-shaped so that ends 14 and 16 proximate each other.

Cap-shaped curved internally threaded beads 20 and 22 are releasably secured over ends 14 and 16, respectively, so that rounded, curved surfaces 24 and 26 of beads 20 and 22, respectively, proximate each other and ends 14 and 16 can be bent toward each other to trap an earlobe (not shown) therebetween.

An ornament 24 such as a heart-shaped pendant of metal, plastic, etc., may be slideably suspended from shaft 18, as by linked rings 26, 28 and 30, the last of which freely slides around shaft 18 but is of narrower internal diameter than the external diameter of beads 20 and 22 so that ornament 24 cannot be slipped off of pin 12 for replacement, except by temporary removal of bead 20 or 22.

Because ornament 24 can freely slide along shaft 18, earring 10 is particularly attractive, ornament 24 moving with each movement of the earlobe to which earring 10 can be affixed. When it is desired to remove earring 10 from an earlobe, ends 14 and 16 can be easily bent away from each other. When it is desired to reuse earring 10, the now bent-out ends 20 and 22 can again be bent toward each other to retrap an earlobe. Thus, earring 10 is inexpensive, light in weight, durable, attractive with interchangeable ornaments and can be rapidly attached to and detached from an earlobe. It can be reused as often as desired. Beads 20 and 22 provide point contact with the earlobe for minimal, if any, skin irritation and maximum comfort.

FIG. 2

Figure 2:
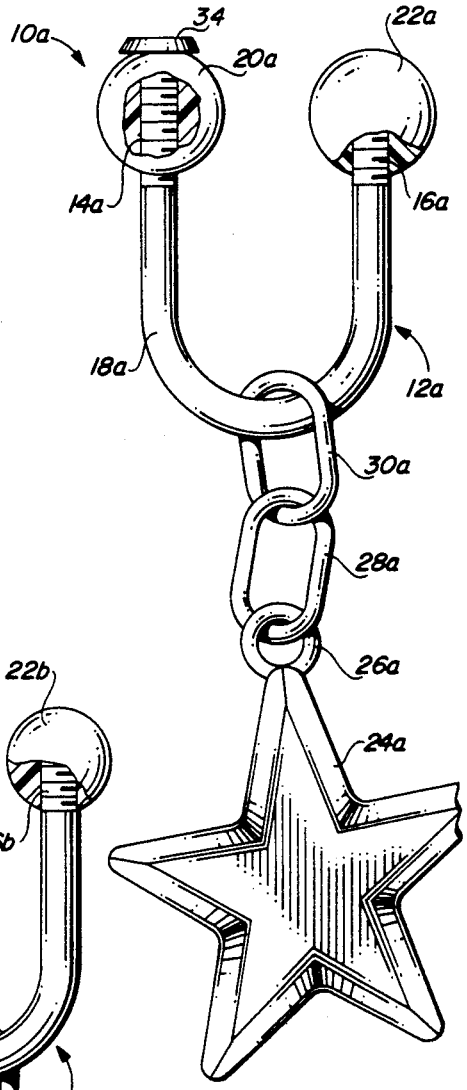
FIG. 2 is a schematic front elevation, partly broken away, of a second preferred embodiment of the improved earring of the present invention.

A second preferred embodiment of the improved earring of the present invention is schematically depicted in FIG. 2. Thus, earring 10*a* is shown. Components thereof similar to those of earring 10 bear the same numerals but are succeeded by the letter "a". Earring 10*a* is identical to earring 10, except as follows:

a) beads 20*a* and 22*a* are round beads but of different diameters;
b) ornament 24*a* is a star instead of a heart and attached to shaft 18*a* by links 26*a* and 30*a;* and,
c) end 14*a* has an expanded head 34.

Earring 10*a* has the advantages of earring 10.

FIG. 3

Figure 3:
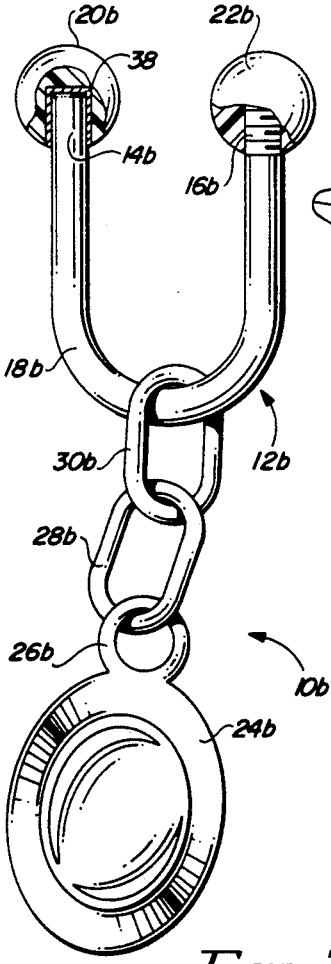
FIG. 3 is a schematic front elevation, partly broken away, of a third preferred embodiment of the improved earring of the present invention; and, FIG. 4 is a schematic front elevation, partly broken away, of a fourth preferred embodiment of the improved earring of the present invention (FIG. 4-(h)) and the method of the present invention for manufacture of the same (FIG. 4-(a) thru (g) ).

A third preferred embodiment of the improved earring of the present invention is schematically depicted in FIG. 3. Thus, earring 10*b* is shown. Components thereof similar to those of FIG. 1 bear the same numerals but are succeeded by the letter "b".

Earring 10*b* is substantially identical to earring 10, except as follows:

a) beads 20*b* and 22*b* are almost fully rounded;
b) bead 20*b* adheres to end 14*b* by a set film 38 of adhesive, such as epoxy resin, glue, etc.; and,
c) ornament 24*b* is a mirrored pendant slideably connected to shaft 18*b* by links 26*b* and 30*b*.

Earring 10*b* has the advantages of earrings 10 and 10*a*.

FIG. 4

A fourth preferred embodiment of the improved earring of the present invention is schematically depicted in FIG. 4 (h). Components thereof similar to those of earrings 10, 10*a* and/or 10*b* bear the same numerals but are succeeded by the letter "c". Earring 10*c* is substantially identical to earring 10*b*, except as follows:

a) pin 12*c* has a head 34*c;* and,
b) ornament 24*c* is a zig-zag cut-out figure slideably attached to shaft 18*c* by a single slide link 26*c*.

Figure 4A:
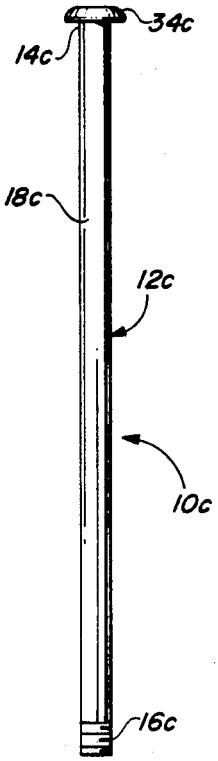
Figure 4B:
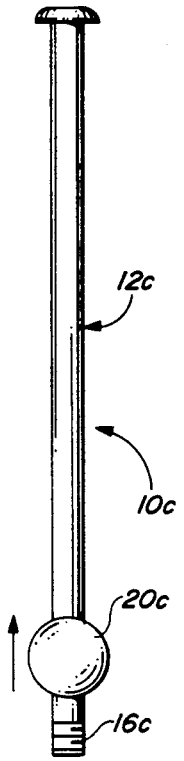
Figure 4C:
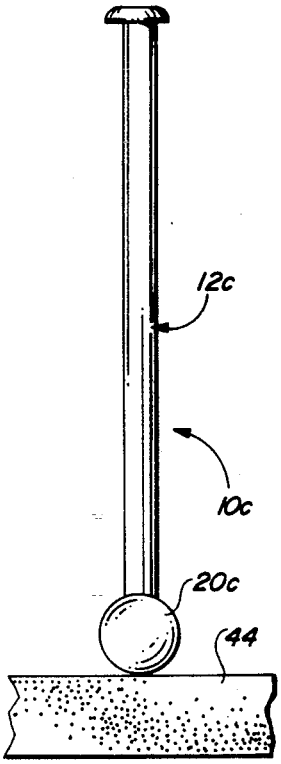
Figure 4D:
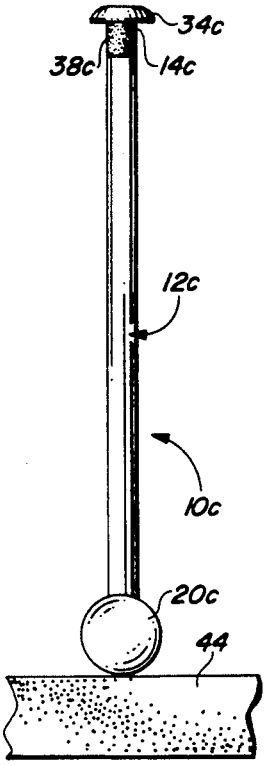
Figure 4E:
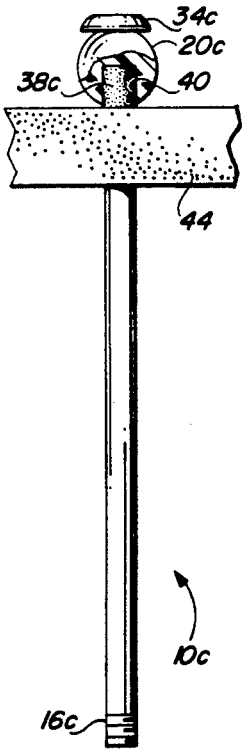
Figure 4F:
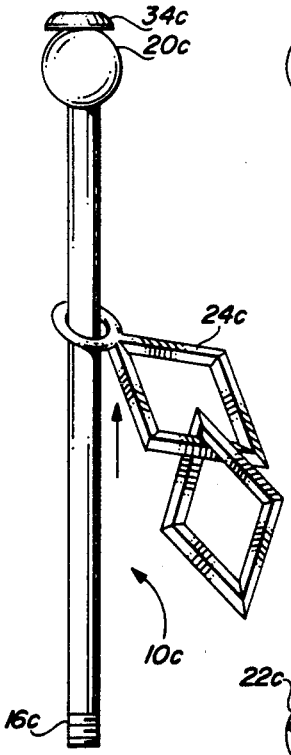
Figure 4G:
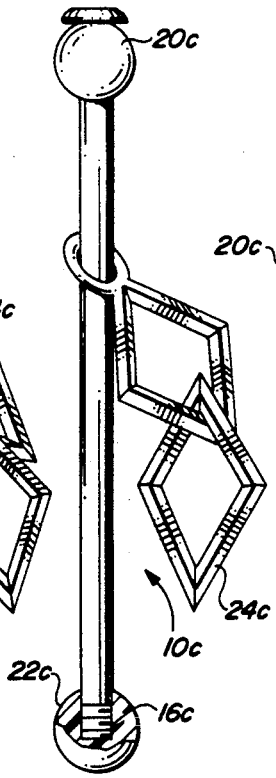
Figure 4H:
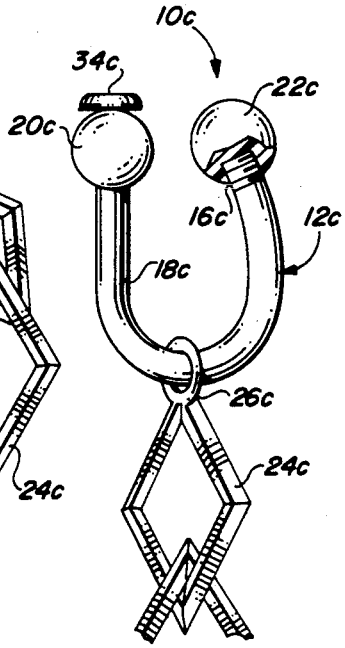

Earring 10*c* is made in accordance with the present method shown in FIG. 4 (a) - thru (g), the steps of which are described as follows:

a) providing vertical straight pin 12*c*, having head 34*c* at top end 14*c* and threaded opposite lower end 14*c* (see FIG. 4(a);
b) sliding curved bead 20*c* up over end 16*c*, bead 20*c* having an internal passageway 40 smaller than the diameter of head 34*c* (see FIG. 4 (b);
c) coating end 14*c* (FIG. 4-(d)) with a film 38*c* of a settable bonding agent, such as epoxy resin or the like,
d) pushing end 16*c* down into a horizontal block or pad 44 of material such as styrofoam, etc. (FIG. 4(c) and (e) until block 44 forces bead 20*c* over film 38*c* and up against head 34*c*;
e) holding bead 20*c* in place until film 38*c* sets to permanently bond bead 20*c* in place at end 14*c;*
f) removing pin 12*c* from block 44 and slipping ornament 24*c* on shaft 18*c* by ring 26*c* from lower end 16*c;*
g) realeasably threading bead 22*c* on end 16*c; and*
h) bending pin 12*c* into its general U-shape so that beads 20*c* and 20*c* approximate each other.

EXAMPLE

As a specific example of the method, the above-described steps were all exactly carried out in sequence, utilizing the following parameters:

| | |
|---|---|
| Pin 12c length | ⅞ inch |
| Pin 12c diameter | 1/64 inch |
| Pin 12c metal | copper |
| Diameter of beads 20c & 22c | 3/16 inch |
| Diameter of beads 20c & 22c | plastic |
| Diameter of head 34e | 1/16 inch |
| Length and width of ornament 24c | ⅜ inch × ½ inch |
| Length and width of ornament 24c | copper plated with brass |
| block 44 | styrofoam |
| Overall length and width of earring 10c | 1 inch and ½ inch |

Earring 10*c* had the advantages of earrings 10, 10*a*, 10*b* and 10*c*.

In the event a pair of earrings as shown in FIG. 4 are desired without an ornament therein, one would not place an ornament on shaft 18(c) as called for in step (f) above, in which event, one can fixedly secure bead 22*c* to the lower end of shaft 18*c*, since removal thereof is not needed to replace an ornament.

Various modifications, changes, alterations and additions can be made in the improved earring of the present invention, its components and parameters, and in the present method, its steps and parameters. All such changes, modifications and alterations as are within the scope of the appended claims form part of the present invention.

What is claimed is:

1. An improved method of making an earring, said method comprising:

a) providing a bendable vertical straight pin having an expanded head at the upper end thereof and an opposite lower end with an integral shaft therebetween;

b) sliding a curved bead with a central passageway therethrough up over said lower pin end to a point above said lower end of said pin, said passageway being of larger diameter than said shaft and lower pin end but smaller diameter than said head;

c) coating said pin shaft just below said head with liquid settable bonding material;

d) pushing said pin down through a horizontal pad until said bead is against said head;

e) holding said bead by said pad against said head until said bonding material sets to bond said bead against said head;

f) removing said pin from said pad;

g) securing a second bead on said pin; and, h) bending said pin into a generally U-shape with the curved surfaces of said beads opposing each other for releasably gripping an earlobe.

2. The improved method of claim 1 wherein said pin shaft is generally cylindrical and of metal and wherein said bonding material is epoxy resin.

* * * * *